US006899203B1

(12) United States Patent
Golden et al.

(10) Patent No.: US 6,899,203 B1
(45) Date of Patent: May 31, 2005

(54) ROPE MANAGEMENT APPARATUS

(76) Inventors: Thayne J. Golden, 5910 Rockwood Ct., Lake Oswego, OR (US) 92035; Perry L. Everett, 225 S. Sunshine La., West Linn, OR (US) 97068; Richard C. Everett, 225 S. Sunshine La., West Linn, OR (US) 97068

( * ) Notice: Subject to any disclaimer, the term of this patent is extended or adjusted under 35 U.S.C. 154(b) by 0 days.

(21) Appl. No.: 10/782,584

(22) Filed: Feb. 18, 2004

(51) Int. Cl.[7] ..... B65H 59/14
(52) U.S. Cl. ..... 188/65.4; 182/5
(58) Field of Search ..... 188/65.1, 65.2, 188/65.3, 65.4, 65.5, 64; 182/3, 4, 5, 11, 182/193

(56) References Cited

U.S. PATENT DOCUMENTS

| | | | | |
|---|---|---|---|---|
| 1,381,311 | A * | 6/1921 | Johnson et al. | 24/134 R |
| 2,330,736 | A | 9/1943 | Paulson | 24/133 |
| 2,976,955 | A * | 3/1961 | Huber | 188/65.1 |
| 3,814,210 | A * | 6/1974 | Hoffman | 182/6 |
| 3,824,653 | A * | 7/1974 | Sholler | 24/134 KB |
| 3,863,893 | A * | 2/1975 | Cavalieri | 254/384 |
| 3,967,349 | A | 7/1976 | Christensen | 24/134 KC |
| 4,217,847 | A | 8/1980 | McCloud | 114/218 |
| 4,480,816 | A * | 11/1984 | Gortan | 254/264 |
| 4,483,517 | A * | 11/1984 | Cavalieri | 254/254 |
| 4,669,582 | A * | 6/1987 | Sandreid | 188/65.1 |
| 4,716,630 | A | 1/1988 | Skyba | 24/134 R |
| 5,054,577 | A * | 10/1991 | Petzl et al. | 182/5 |
| 5,076,400 | A * | 12/1991 | Petzl et al. | 188/65.5 |
| 5,083,350 | A * | 1/1992 | Sandreid | 24/134 R |
| 5,279,020 | A * | 1/1994 | Coe | 24/134 P |
| 5,544,723 | A | 8/1996 | Gettemy | |
| 5,850,893 | A * | 12/1998 | Hede et al. | 182/193 |
| 5,921,353 | A * | 7/1999 | Day | 188/65.4 |
| 5,954,153 | A * | 9/1999 | Rogelja | 182/5 |
| 6,029,777 | A * | 2/2000 | Rogelja | 182/193 |
| 6,155,384 | A * | 12/2000 | Paglioli | 188/65.2 |
| 6,378,650 | B2 * | 4/2002 | Mauthner | 182/5 |
| 6,446,753 | B1 * | 9/2002 | Novak | 182/193 |
| 6,732,833 | B2 * | 5/2004 | Rogelja | 182/5 |

FOREIGN PATENT DOCUMENTS

DE 10219492 * 11/2003

* cited by examiner

*Primary Examiner*—Robert A. Siconolfi
*Assistant Examiner*—Devon Kramer
(74) *Attorney, Agent, or Firm*—Marger Johnson & McCollom, P.C.

(57) ABSTRACT

Embodiments of the invention provide a simple and convenient way to ascend and descend a rope without using a belayer. Embodiments of the invention can smoothly transition from a rope clamping position to a rope unclamping position, conveniently providing an effective rope management tool. Other embodiments of the invention are described in the appended claims.

25 Claims, 7 Drawing Sheets

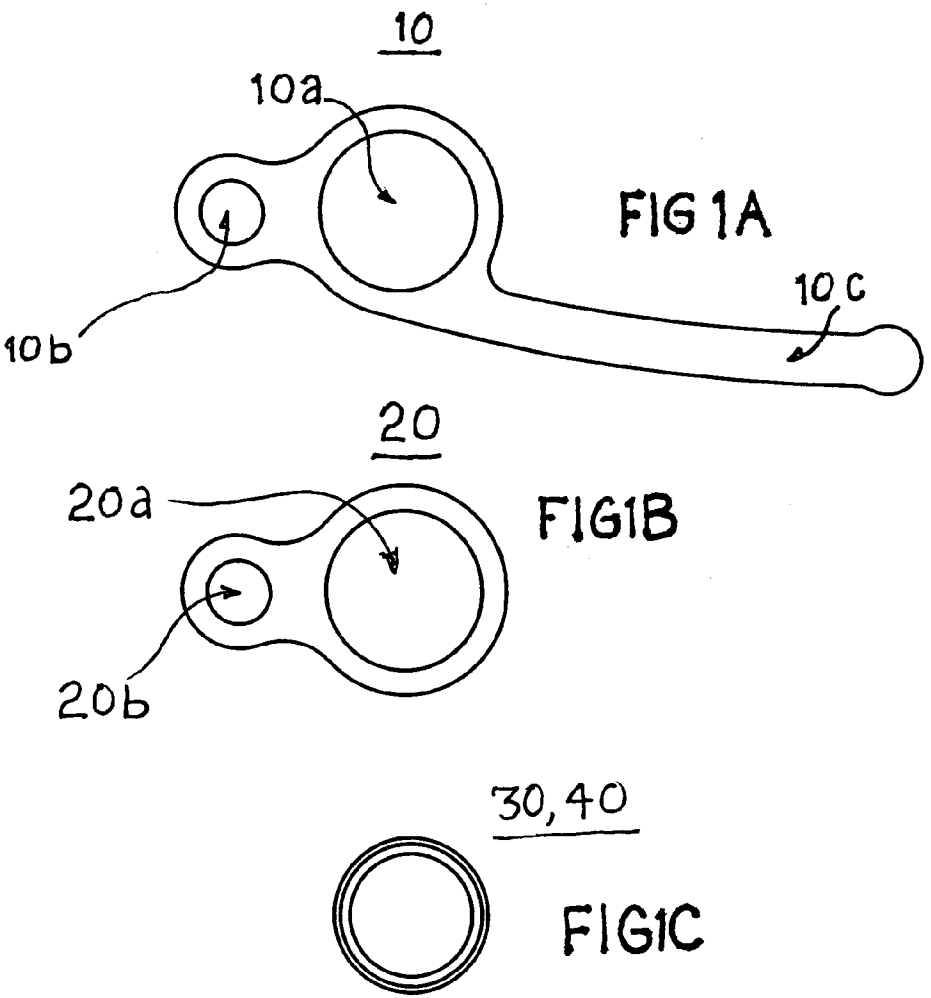
FIG 1A
FIG1B
FIG1C
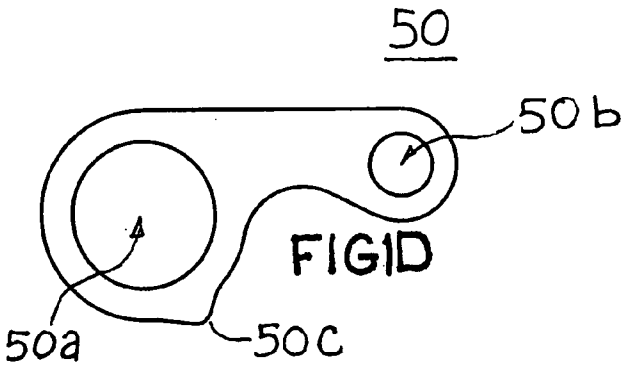
FIG1D
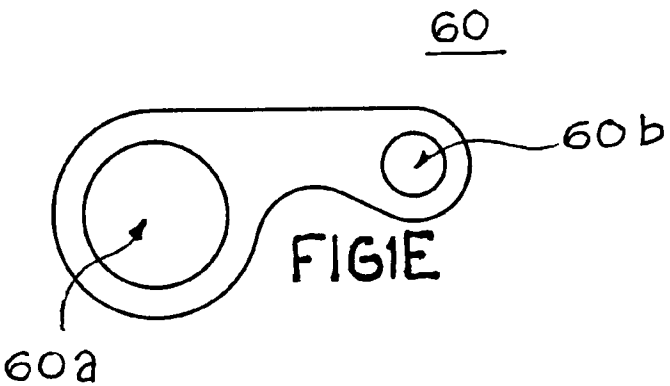
FIG1E

ROPE MANAGEMENT APPARATUS

BACKGROUND OF THE INVENTION

1. Technical Field of the Invention

This invention relates generally to rope management devices, and more particularly, to an apparatus for ascending and descending a rope without the assistance of a belayer.

2. Description of the Related Art

Cam cleat devices which permit a rope to move freely in one direction, while automatically engaging and stopping a rope from passing in the opposite direction, are well known.

Examples of such devices are described in U.S. Pat. No. 4,716,630 to Helmut Skyba and U.S. Pat. No. 4,217,847 to Robert McCloud. These devices employ camming apparatus to ascend a rope. However, once a fall has occurred, the rope is jammed so tightly by the cams that all weight must be removed from the device in order to release the rope. For obvious reasons, such devices are not suitable for use as a descender, therefore other systems are required, adding weight and inconvenience to the user's load.

An example of a device specifically designed for descending a rope is described in U.S. Pat. No. 5,076,400 to Paul and Pierre Petzl. Not only is this device not capable of acting as an ascender, the device contains several pulleys and a pre-tensioned spring that requires a threshold adjustment based on the weight of the user to optimize performance of the device. This adds a certain amount of inconvenience to the user, especially if several people are sharing the same climbing equipment.

In U.S. Pat. No. 5,544,723 to Donald Gettemy, a self-belay device suitable for both ascending and descending a rope is described. This device has many components, and in order to use it an end of the rope must be threaded through four different holes. Thus, the device cannot be easily detached and removed unless one is near the end of the rope. Additionally, the device is fairly inconvenient since the rope must be placed in a different configuration depending on whether one is ascending or descending the rope. In some situations this may not be such a detractor, but in typical situations constant up and down adjustments are necessary. Furthermore, when the device is configured as a descender, the rope essentially slides freely through the apparatus. In other words, the user cannot employ the device to provide friction to slow down or speed up the descent, this must be provided by some other means or device.

Embodiments of the invention address these and other disadvantages of the conventional art.

BRIEF DESCRIPTION OF THE DRAWINGS

FIGS. 1A–1E are plan view diagrams that illustrate components of a rope management device according to an embodiment of the invention.

DETAILED DESCRIPTION OF THE INVENTION

Figure 2A:
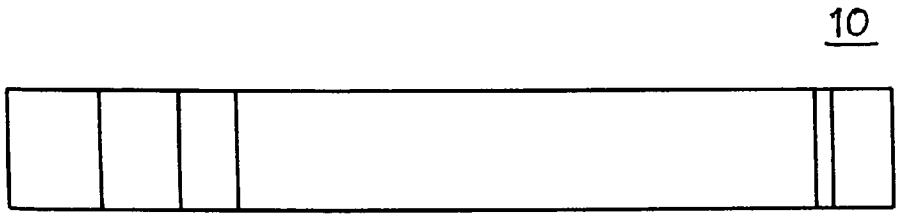
FIGS. 2A–2E are profile view diagrams corresponding to FIGS. 1A–1E.
Figure 2B:
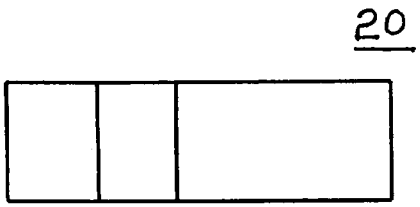
Figure 2C:
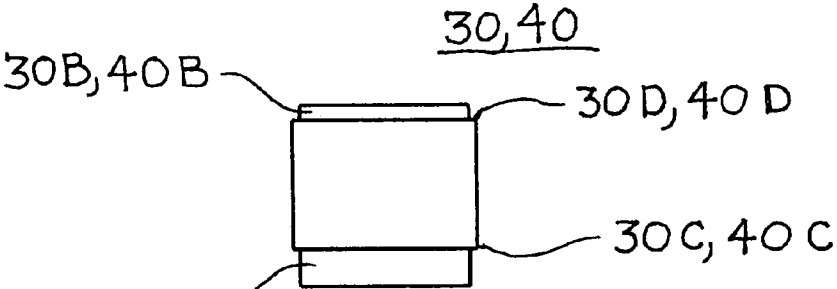
Figure 2D:
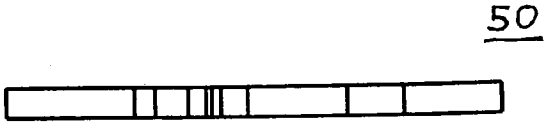
Figure 2E:
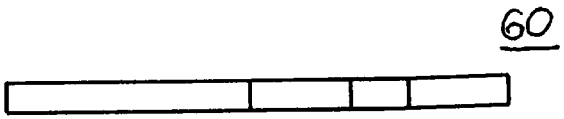
Figure 3:
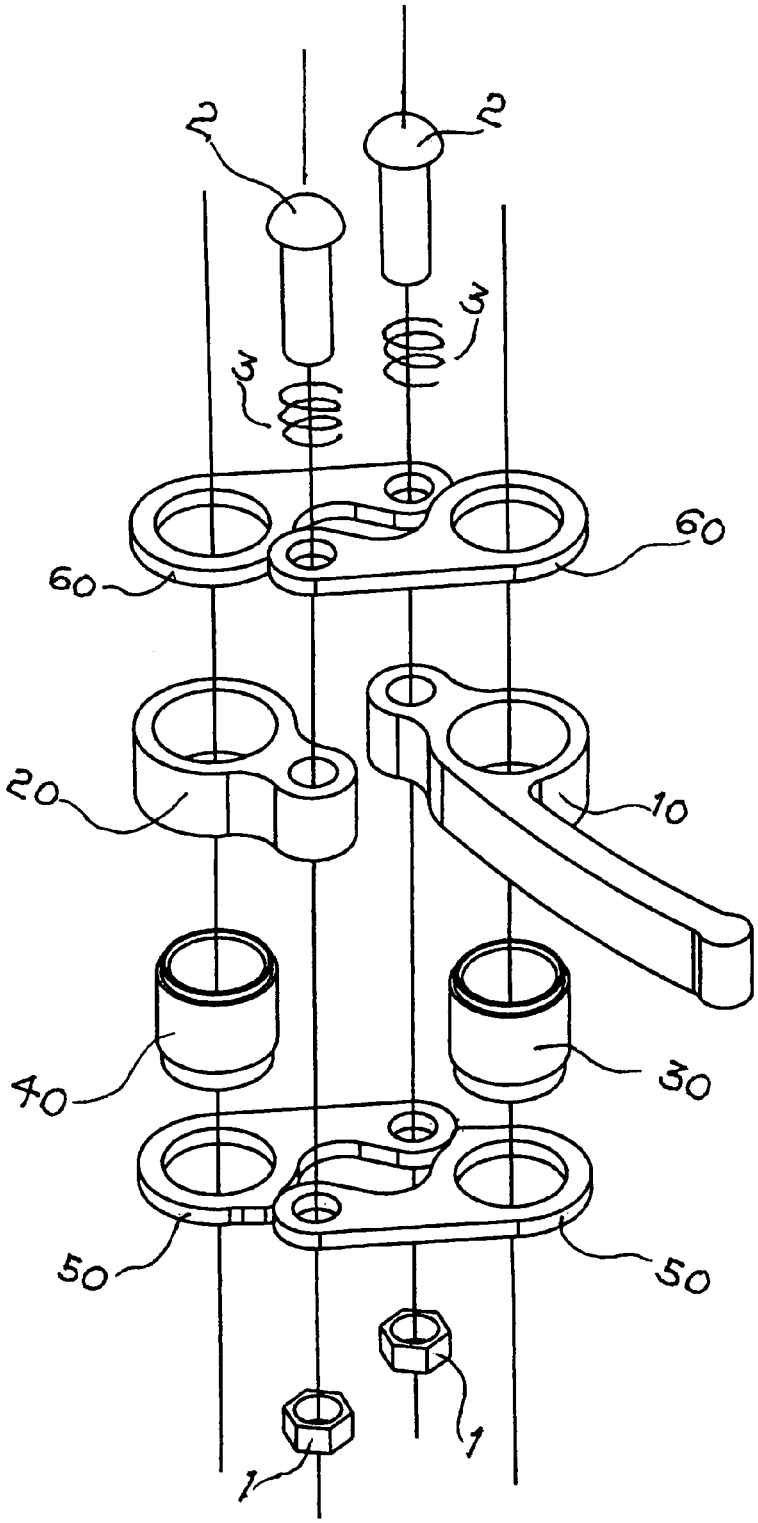
FIG. 3 is an exploded perspective diagram illustrating how the components of the rope management device of FIGS. 1 and 2 are assembled in relationship to each other.

FIGS. 1A–1E are plan view diagrams that illustrate some components of a rope management device according to an embodiment of the invention. FIGS. 2A–2E are profile view diagrams corresponding to FIGS. 1A–1E. FIG. 3 is an exploded perspective diagram illustrating how the components of the rope management device of FIGS. 1 and 2 are assembled in relationship to each other.

With reference to FIGS. 1A–1E, 2A–2E, and 3, some individual components of a rope management device according to an embodiment of the invention will be described below, along with their relationship to one another in the completely assembled rope management device.

A rope management device according to an embodiment of the invention includes an upper brake 10 (FIG. 1A), a lower brake 20 (FIG. 1B), an upper bushing 30 (FIG. 1C), a lower bushing 40 (FIG. 1C), two fixed sideplates 50 (one of which is illustrated in FIG. 1D), and two access sideplates 60 (one of which is illustrated in FIG. 1E).

The upper brake 10 includes a large pivot hole 10*a* and a small pivot hole 10*b*. In addition to pivot holes 10*a*, 10*b*, the upper brake also includes a brake release lever 10*e*. As shown in FIGS. 1, 2, and 3, the brake release lever 10*c* is preferably an integral part of the upper brake 10.

The lower brake 20 is similar to the upper brake 10 in that it also includes a large pivot hole 20*a* and a small pivot hole 20*b*. Preferably, the diameters of the large pivot holes 10*a*, 20*a* are substantially equal to each other and the diameters of the small pivot holes 10*b*, 20*b* are also substantially equal to each other.

The upper bushing 30 is a cylindrical metal lining that is inserted into the large pivot hole 10*a* of the upper brake 10. The lower bushing 40 is a cylindrical metal lining that is inserted into the large pivot hole 20*a* of the lower brake 20. Preferably, the outside diameter of the upper bushing 30 and the lower bushing 40 are substantially equal to each other. In order to fit within the large pivot holes 10*a*, 20*a*, the outside diameters of the upper and lower bushings 30, 40 are also slightly smaller than the diameters of the large pivot holes 10*a*, 20*a*. Thus, the upper and lower bushings 30, 40 may rotate within the large pivot holes 10*a*, 20*a*, respectively.

Preferably, the length of the upper bushing 30 and the lower bushing 40 is greater than the thickness of the upper brake 10 and the lower brake 20, respectively.

Preferably, the ends of the upper bushing 30 have steps 30*c* and 30*d* where the outer diameter of the bushing 30 abruptly decreases. The steps 30*c* and 30*d* mark the beginning of the collar portion, or collars 30*a*, 30*b* of the bushing 30, respectively. Similarly, the ends of the lower bushing 40 have steps 40*c*, 40*d* where the outer diameter of the bushing 40 abruptly decreases, marking the beginning of the collars 40*a*, 40*b* of the bushing 40. The purpose of the steps 30*c*, 30*d*, 40*c*, 40*d* and collars 30*a*, 30*b*, 40*a*, 40*b* will be clarified further below in the specification. The distance between the steps 30*c* and 30*d* of the upper bushing 30 and the distance between the steps 40*c* and 40*d* of the lower bushing 40 are also preferably greater than the thickness of the upper brake 10 and the lower brake 20, respectively.

The rope management device also includes two fixed sideplates 50 and two access sideplates 60. Each of the fixed sideplates 50 has a large hole 50*a* and a small hole 50*b*. Each of the access sideplates 60 has a large hole 60*a* and a small hole 60*b*. Preferably, as will become clear further below in the specification, the diameters of the large holes 50*a*, 60*a* are slightly smaller than the diameters of the large pivot holes 10*a*, 20*a*. Preferably, the diameters of the small holes 50*b*, 60*b* are substantially equal to the diameters of the small pivot holes 10*b*, 20*b*.

As shown in FIG. 1D, the fixed sideplates also include small protrusions, or stops 50*c*, on the outside edge of the fixed sideplates 50 near the large holes 50*a*. The purpose of the stops 50*c* will become clear further below in the specification.

As shown in FIG. 3, the upper and lower bushings 30, 40 are inserted in the large pivot holes 10*a*, 20*a*, respectively. The large holes 50*a* of the two fixed sideplates 50 are placed over the ends of the bushings 30, 40. The steps 30*c* and 40*c* limit the distance that the two fixed sideplates 50 travel down the bushings 30, 40. In other words, the steps 30*c* and 40*c* maintain the fixed sideplates' 50 position on the collars 30*a* and 40*a*, respectively. When the fixed plates 50 are touching the steps 30*c*, 40*c*, a small portion of the collars 30*a*, 40*a* extend above the surface of the fixed sideplates. The bushings 30, 40 are preferably permanently affixed to the fixed sideplates 50 by riveting. This riveting process causes the small portion of the collars 30*a*, 40*a* that extend slightly above the surface of the fixed sideplate 50 to bow outwards over the circumference of the large holes 50*a*, thus preventing the fixed sideplates 50 from detaching from the bushings 30, 40. It is for this reason that the fixed sideplates 50 are referred to as "fixed."

The access sideplates 60 fit over the ends of the bushings 30, 40, but are not permanently affixed to them. Rather, the large holes 60*a* of the access sideplates 60 are kept in alignment with the bushings 30, 40 by being slipped over the collars 30*b*, 40*b*. The diameter of the large holes 60*a* of the access sideplates 60 is large enough to fit over the collars 30*b*, 40*b* but too small to allow the access sideplates 60 to go past the steps 30*d*, 40*d*.

As was explained above, the distance between the steps 30*c* and 30*d* on the upper bushing 30 is greater than the thickness of the upper brake 10. Similarly, the distance between the steps 40*c* and 40*d* on the lower bushing 40 is greater than the thickness of the lower brake 20. Thus, regardless of the forces applied against the fixed sideplates 50 and the access sideplates 60, the sideplates will not bind against the upper brake 10 or the lower brake 20.

As shown in FIG. 3, the small hole 50*b* of the fixed sideplate 50 that is attached to the upper bushing 30 is aligned with the small pivot hole 20*b* of the lower brake 20. Likewise, the small hole 50*b* of the fixed sideplate 50 that is attached to the lower bushing 40 is aligned with the small pivot hole 10*b* of the upper brake 10.

Furthermore, the access sideplate 60 whose large hole 60*a* is aligned with the large pivot hole 10*a* of the upper brake 10 is arranged so that the small hole 60*b* is aligned with the small pivot hole 20*b* of the lower brake 20. Likewise, the access sideplate 60 whose large hole 60*a* is aligned with the large pivot hole 20*a* of the lower brake 20 is arranged so that the small hole 60*b* is aligned with the small pivot hole 10*b* of the upper brake 10.

As shown in FIG. 3, the access sideplates 60 and the fixed sideplates 50 are held against the steps 30*c*, 30*d* of the upper bushing 30 and against the steps 40*c*, 40*d* of the lower bushing 40 with two nuts 1, two bolts 2, and two springs 3. One bolt 2 is inserted through a spring 3, the small hole 60*b* of an access sideplate 60, the small pivot hole 10*b* of the upper brake 10, and the small hole 50*b* of a fixed sideplate 50. The other bolt 2 is inserted through another spring 3, the small hole 60*b* of the other access sideplate 60, the small pivot hole 20*b* of the lower brake 20, and the small hole 50*b* of the other fixed sideplate 50.

Preferably, the two nuts 1 are permanently affixed to the two bolts 2 such that the two springs 3 provides sufficient tension to hold the access plates 60 against the steps 30*d*, 40*d* of the upper and lower bushings 30, 40. Consequently, by applying pressure against the access plates 60, the user may depress the springs 3 enough to move the access plates off of the ends of the bushings 30, 40. While the access plates 60 may be removed from the ends of the bushings 30, 40, they still remain permanently affixed to the rope management device by the bolts 2 and corresponding nuts 1. This allows the user to rotate the access plates 60 away from the channel defined between the upper brake 10 and the lower brake 20. This movement of the access plates 60 allows a rope to be quickly and easily inserted or removed from the channel between the upper brake 10 and the lower brake 20. It is for this reason that the access plates 60 are described as "access."

Although the nut 1 may be permanently affixed to the bolt 2, it should be recognized that the position of the nut 1 on the bolt 2 should not be such that it binds fixed sideplates 50 and access sideplates 60 or otherwise impedes their rotation with respect to the upper brake 10 and lower brake 20.

Those of skill in the art will recognize that there are other conventional components that may be used in place of the nuts 1, bolts 2, and springs 3 to accomplish the same function described above. For example, instead of a spring 3, a flexible washer may be used to hold the access plates 60 on the collars 30*b*, 40*b* of the bushings 30, 40. Similarly, rivets or pins may be used instead of nuts and bolts. All such alternative embodiments are intended to be covered by the scope of the appended claims.

Figure 4A:
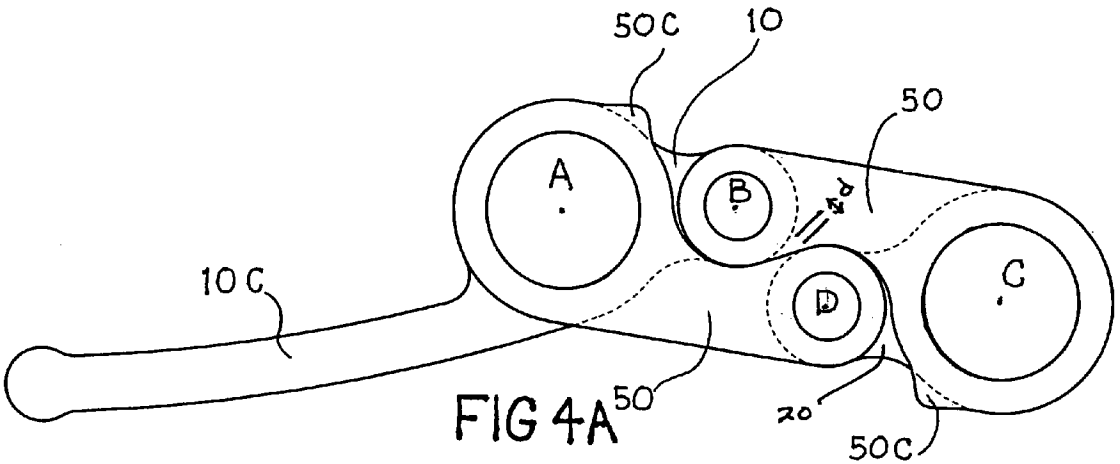
FIGS. 4A and 4B are plan view diagrams illustrating the range of motion achieved by the assembled rope management device of FIG. 3.
Figure 4B:
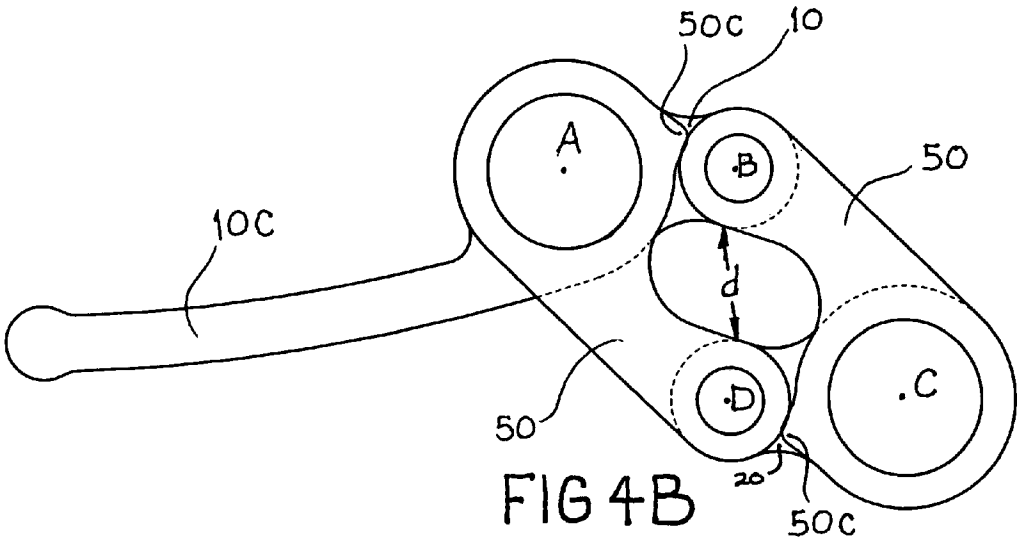

FIGS. 4A and 4B are plan view diagrams illustrating the range of motion achieved by the assembled rope management device. FIGS. 4A and 4B show the assembled rope management device at the extremes of its range of motion. The nuts 1, bolts 2, and springs 3 that were shown in FIG. 3 are not illustrated in FIG. 4 in order to more easily explain this aspect of embodiments of the invention. In FIG. 4, only the fixed plates 50 are visible so that the function of the stops 50*c* may be more readily explained. In alternative embodiments of the invention, stops may be included on the access plates 60, or stops may be included both on the fixed plates 50 and the access plates 60.

With reference to FIG. 4, the centers of the large and small pivot holes 10*a*, 10*b* of the upper brake 10 and the centers of the large and small pivot holes 20*a*, 20*b* of the lower brake 20 together define four pivots A, B, C, D, where each pivot axis runs longitudinally through the center of each of the pivot holes 10*a*, 10*b*, 20*a*, and 20*b*. In FIG. 4, the edges of the upper brake 10 and the lower brake 20 that are behind the fixed plates 50 are indicated by dashed lines.

According to embodiments of the invention, the pivot points A, B, C, and D generally define a quadrilateral, or a polygon having four sides. Preferably, and in the particular embodiment of the invention illustrated in FIG. 4, the pivot points A, B, C, D define a special case of quadrilateral known as a parallelogram where opposite sides of the parallelogram are equal, opposite angles of the parallelogram are equal, and opposite sides of the parallelogram remain parallel to each other. This relationship between the opposite sides and the opposite angles of parallelogram ABCD holds true throughout the range of motion of the rope management device. A parallelogram arrangement is preferred because it is cost effective, but other embodiments of the invention may have pivot points A, B, C, D that define a quadrilateral of any size or shape.

As was explained above, the fixed plates 50 and the access plates 60 are rotatably affixed to the upper and lower brakes 10, 20 at the pivot points A, B, C, D with the bushings 30, 40 and the nuts 1 and bolts 2. FIG. 4A represents one extreme position of the rope management device and FIG. 4B represents another extreme position of the rope management device. Because the bushings 30, 40 allow the fixed and access sideplates 50, 60 to rotate easily with respect to the upper brake 10 and lower brake 20, the rope management device may easily assume any position between the extremes represented by FIG. 4A and FIG. 4B when there is not a rope inserted in the device. The case when a rope is inserted in the rope management device during a typical operational situation will be explained further below in the specification.

As the rope management device transitions from the position illustrated in FIG. 4A to the position illustrated in FIG. 4B, the segment AB remains parallel to the segment CD, the segment BC remains parallel to the segment DA, and the distance between the upper brake 10 and the lower brake 20 increases.

In this embodiment of the invention, the range of motion of the rope management device is limited by the shape of the fixed plates 50 and the access plates 60, as will be explained below.

In FIG. 4A, the distance (d) between the upper brake 10 and the lower brake 20 is at its smallest possible value. The distance (d) is prevented from becoming any smaller because each of the fixed plates 50 is in contact with the other fixed plate 50. Likewise, although not shown in FIG. 4A, each of the access plates 60 is in contact with the other. Thus, the angles DAB and BCD may not decrease past the point shown. As will be explained further below, this position corresponds to a clamped position of the rope management device.

In FIG. 4B, the distance (d) between the upper brake 10 and the lower brake 20 is at its largest possible value. Each of the stops 50*c* on each of the fixed plates 50 is now in contact with the other fixed plate 50. Thus, the angles DAB and BCD may not increase past the point shown. As will be explained below, this position corresponds to an open position of the rope management device.

Figure 5B:
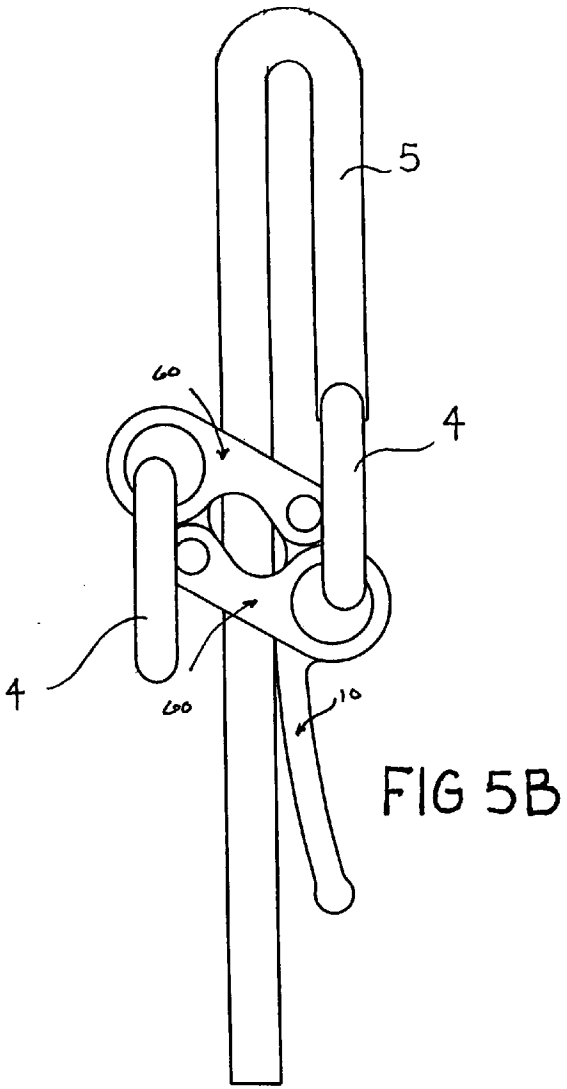
FIGS. 5A and 5B are diagrams illustrating the operation of the rope management device of FIG. 4.
Figure 5A:
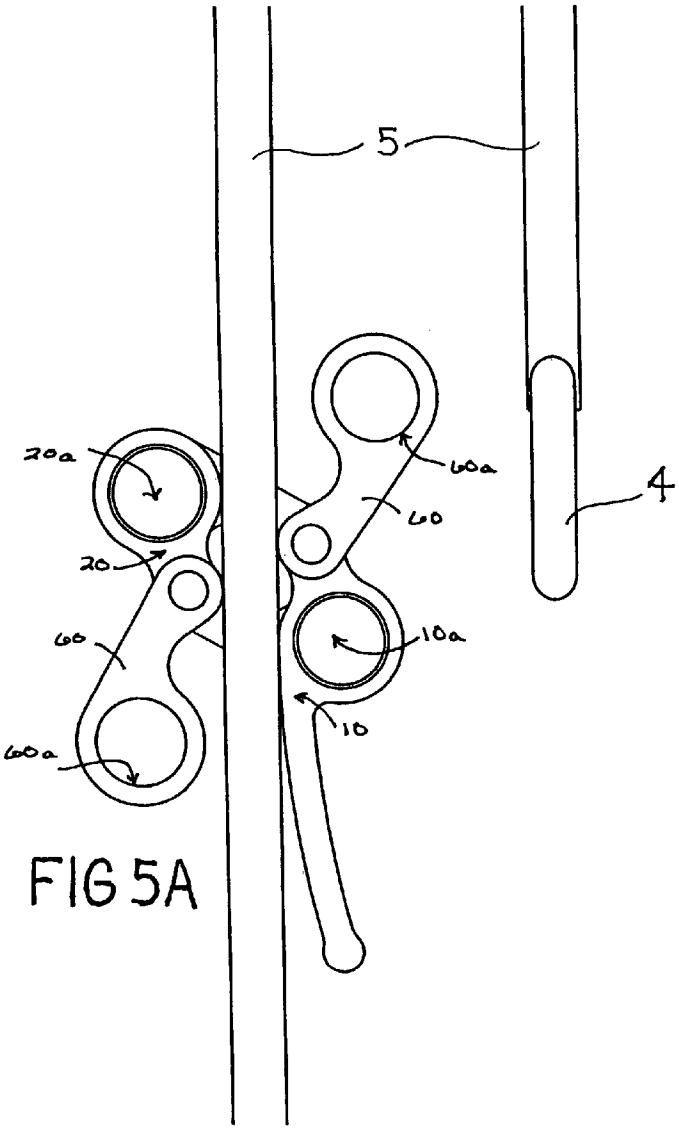

FIGS. 5A and 5B are diagrams illustrating an operational configuration for the rope management device of FIG. 4. As shown in FIG. 5B, the diameter of the large holes 50*a* of the fixed sideplates 50, the diameter of the large holes 60*a* of the access sideplates 60, the inner diameter of the upper bushing 30, and the inner diameter of the lower bushing 40 are large enough to allow a connector such as a carabiner 4 to be connected to the rope management device through the large pivot holes 10*a*, 20*a*. The carabiner 4 is a conventional device well known in the art and so will not be explained in further detail here.

The end of a rope 5 is tied to the carabiner 4 that is connected to the upper brake 10. The rope 5 runs upward, passes around an anchor (not shown), and back down through a channel defined between the upper brake 10 and the lower brake 20. The anchor may be a pulley, another carabiner 4, a pipe, or some other conventional device.

As explained above and illustrated in FIG. 5A, the rope 5 may be easily placed into or removed from the rope management device by depressing the springs 3 that hold the large holes 60*a* of the access plates 60 on the collar 30*b* of upper bushing 30 and the collar 40*b* of the lower bushing 40. When the springs 3 are depressed, the access plates 60 may be lifted off the collars 30*b*, 40*b* and rotated away from the bushings 30, 40, as shown in FIG. 5A. This allows the rope 5 to be easily inserted or removed from the channel region defined between the upper brake 10 and the lower brake 20.

As shown in FIG. 5B, once the rope is placed within the channel between the upper brake 10 and the lower brake 20, the access plates 60 may be rotated and replaced over the bushings 30, 40, where they are again held securely on the bushings by the tension supplied by the springs 3.

Like the carabiner 4 attached to the upper brake 10, a carabiner 4 may also be connected to the lower brake 20 through the large pivot hole 20*a*. This carabiner 4 is, in turn, connected to a relatively short length of lanyard, cable, or another rope (not shown). The end of this relatively short piece of lanyard, cable, or rope is typically connected in some fashion to the person that is using the rope 5. Thus, the rope 5 forms, when placed in the rope management device, a parallel or double line configuration above the rope management device.

Alternatively, devices other than carabiners 4 may be used to connect the end of the rope 5 to the upper brake 10 or to connect the user of the device to the lower brake 20. For example, the rope 5 may be tied directly through the large pivot hole 10*a* of the upper brake 10, or the user of the device may prefer to tie the lanyard (not shown) directly through the large pivot hole 20*a* of the lower brake 20. The wide variety of ways that connectors such as ropes, webbing, cables, carabiners, and other conventional devices may be attached to the rope management device through the large pivot holes 10*a*, 20*a* are too numerous to mention but are well-known to those of skill in the art. They are also not required for a clear explanation of embodiments of the invention so they will not be explained in further detail here.

Figure 6B:
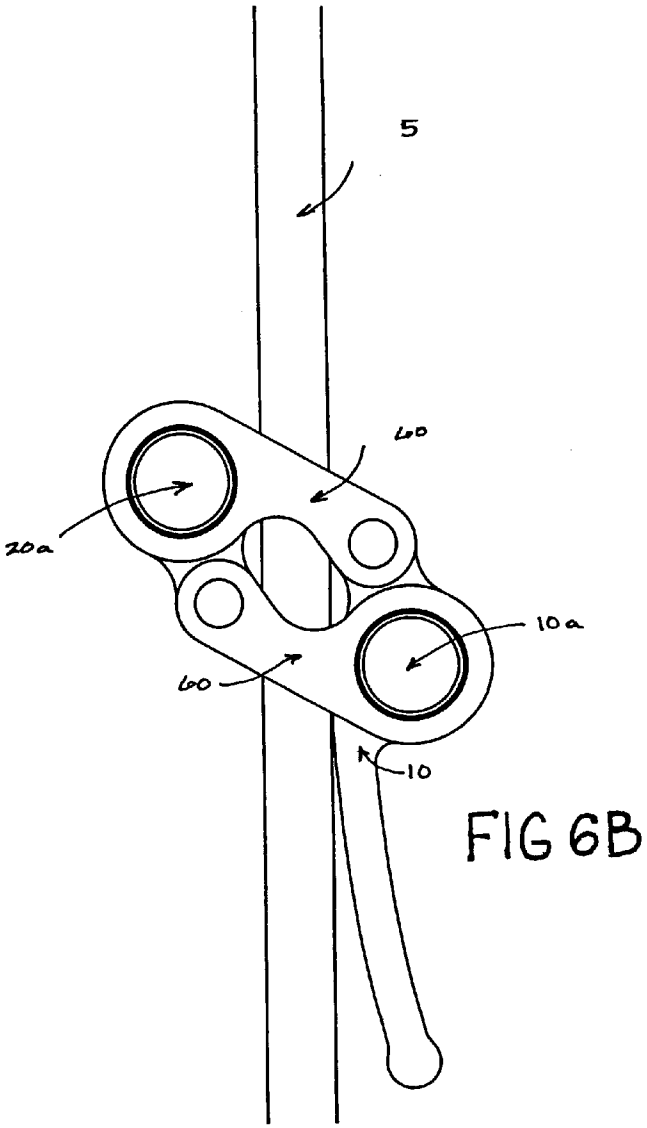
FIGS. 6A and 6B are diagrams illustrating the rope management device of FIG. 4 in clamped and open positions, respectively.
Figure 6A:
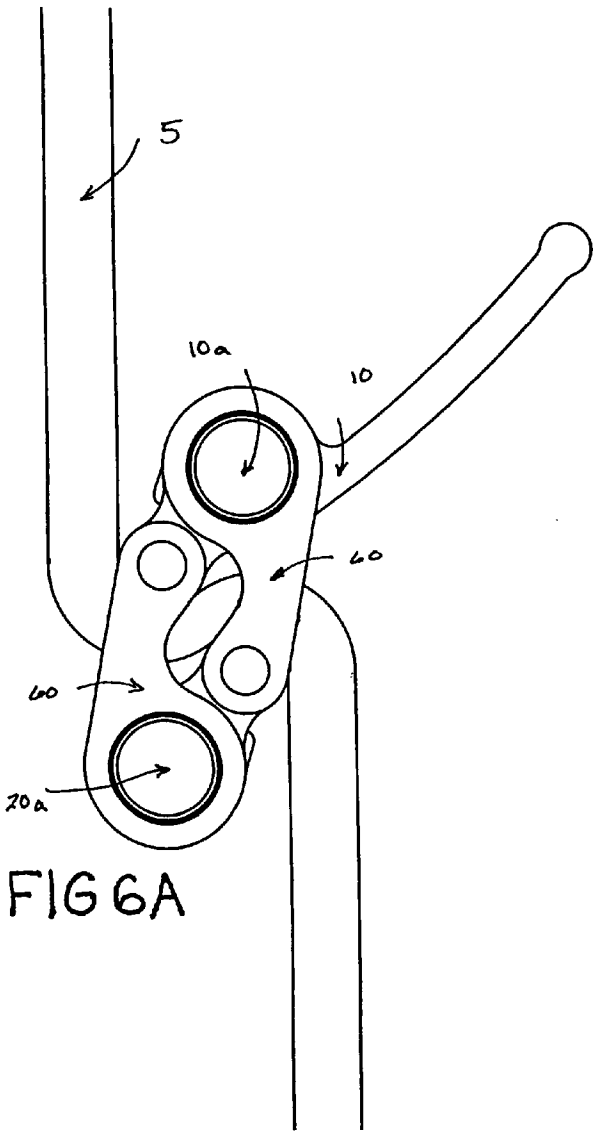
Figure 7B:
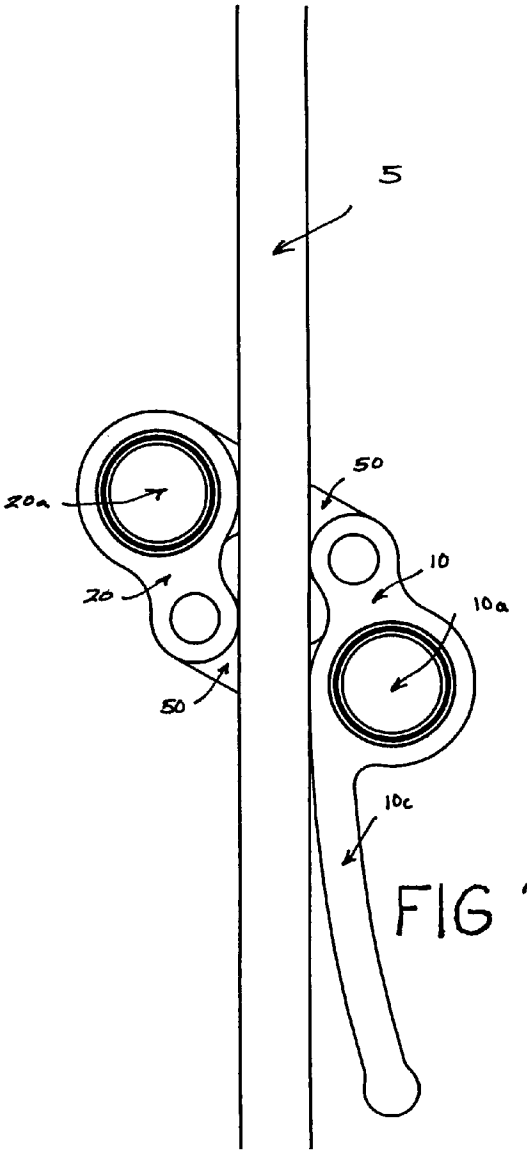
FIGS. 7A and 7B are diagrams corresponding to FIG. 6A and FIG. 6B, respectively, but with one of the components of the rope management device removed to more clearly show the position of the rope within the rope management device.
Figure 7A:
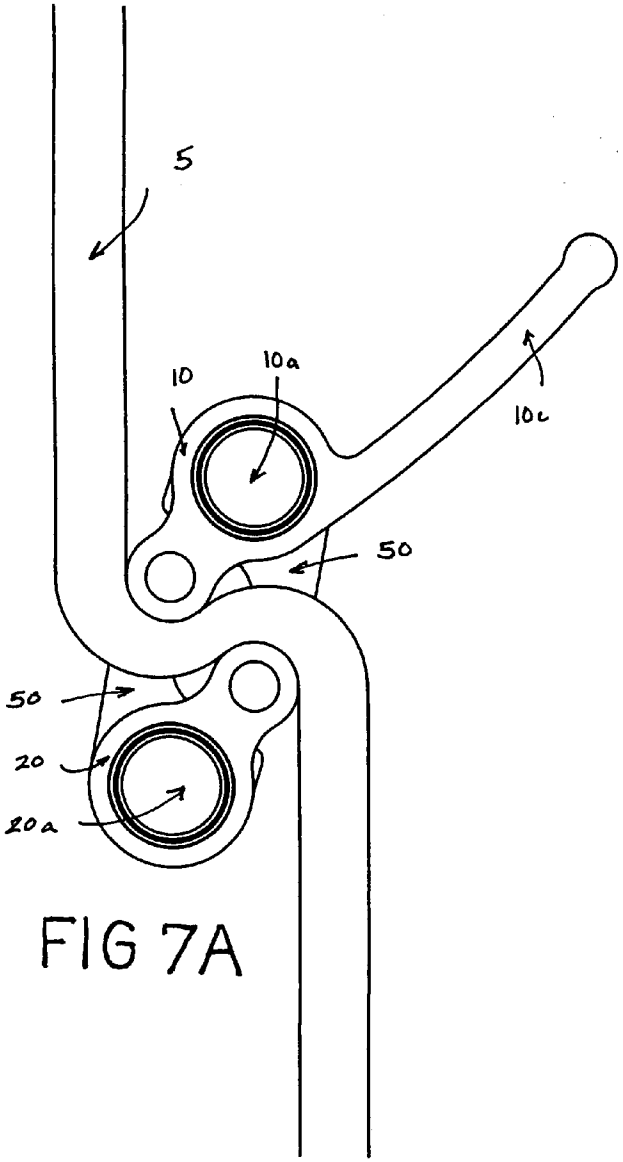

FIGS. 6A and 6B are diagrams illustrating the rope management device of FIG. 4 in a clamped position and an opened position, respectively. FIGS. 7A and 7B are diagrams corresponding to FIGS. 6A and 6B, respectively, but with the access sideplates 60 removed to more clearly show the position of the rope within the rope management device. Although not shown in FIGS. 6 and 7, it is assumed that the end of the rope is connected to the rope management device and that a user is connected to the rope management device in the manner as explained with reference to FIG. 5. These connections are not shown in FIGS. 6 and 7 in order to not obscure the operation of the rope management device. Referring to FIGS. 6 and 7, the operation of the rope management device when a rope 5 is inserted in the device will now be explained.

A clamped position of the rope management device, illustrated in FIGS. 6A and 7A, will automatically be achieved if forces are applied to the rope management device that tend to pull the pivot points A and C (see FIG. 4A) apart. In this situation, forces act against the rope management device in several directions. There is a force pulling upwards at pivot point A. There is also a force pulling downwards at pivot point C. Thus, referring to FIG. 4, the natural tendency of the rope management device is for the angles DAB and BCD to collapse as the pivot points A and C are pulled apart, minimizing the distance (d) between the upper brake 10 and the lower brake 20. As the distance (d) is minimized, the channel between the upper brake 10 and the lower brake 20 becomes smaller. Consequently, the upper brake 10 and the lower brake 20 provide a clamping force to the rope 5 that helps prevent the rope 5 from moving through the device.

The rope management device also applies an increased frictional force to the rope 5 that also prevents it from moving through the rope management device. As can be seen in FIGS. 6A and 7A, when forces are pulling the pivot points A and C apart, the channel between the upper brake 10 and the lower brake 20 imparts an increasingly severe S-shaped bend to the rope 5. The degree of bend imparted to the rope 5 by the channel causes more of the rope to contact surfaces of the upper brake 10 and the lower brake 20. Consequently, more friction is provided against the rope 5 because it is in contact with a larger surface area of the brakes 10, 20.

The rope management device tends to assume the opened position, illustrated in FIGS. 6B and 7B, when the user pulls on the portion of the rope 5 that hangs below the rope management device to pull himself up the rope. In this situation, the forces applied to the rope management device are configured differently. There is still a force pulling upward on the device at pivot point A. However, when the user supports and lifts his weight by pulling on the rope 5, there is no longer a force applied downward at pivot point C.

Consequently, referring to FIG. 4, the angles DAB and BCD are not forced to become smaller. Instead, the increased tension on the rope 5 forces the pivot points B and D (as well as the rest of the rope management device) to rotate in the clockwise direction, causing the channel defined between the upper brake 10 and the lower brake 20 where the rope 5 is positioned to become more parallel with respect to the orientation of the rope. In other words, the S-shaped bend placed in the rope by the rope management device becomes less severe as when compared to the clamped position, and there is less friction applied to the rope 5. The forces on the rope 5 also tend to increase the angles DAB and BCD of the rope management device, thereby increasing the distance (d) between the upper brake 10 and lower brake 20 and reducing the clamping effect on the rope 5.

In other words, when the tension that is on the rope 5 below the rope management device is increased and the force applied against the pivot point C is decreased, the rope management device will tend naturally towards the open position. Thus, the rope management device may slide easily along the rope 5 with minimal resistance as the user pulls rope through the device. In other words, the user of the rope management device need not worry about the device maintaining its position with respect to the user, since the device is easily pulled along the rope. This is sometimes referred to as a "self-advancing" feature.

Thus, if force is entirely removed from the pivot point C, both the clamping force and the frictional force are removed from the rope 5 and the rope management device may smoothly slide along the rope 5 as the user ascends. In other words, if the user's weight is transferred to the rope 5 that is below the rope management device, the device will release the rope.

In order to rest during the ascent of the rope 5, the user may release the rope 5, causing a downward force to be applied once again to the pivot point C, resulting once again in the clamped position of FIGS. 6A and 7A. As the rope management device returns to the clamped position from the open position of FIGS. 6B and 7B, it rotates in a counter-clockwise direction.

It should be noted that in FIGS. 5, 6, and 7 the rope management device is illustrated in a configuration that is typically most convenient for a right-handed user, with the brake release lever 10*c* of the upper brake 10 pointing towards the right, and with the user facing the access sideplates 60. The rope management device may easily be set up for a left-handed user. In this case, the brake release lever 10*c* would point toward the left and the user would face the fixed sideplates 50 of the rope management device. The operation of the rope management device would remain unchanged, except that it would appear to the left-handed user that the device rotates in a clockwise direction when transitioning to the clamped position and in a counter-clockwise direction when transitioning to the open position.

It should also be noted that the situations described above assume that the person using the rope management device is moving vertically with the aid of the rope 5 only. In more typical situations, the user is actually moving on a rock face, tree branches, a tall ladder, a steeply angled roof, or scaffolding. The user may not even be ascending or descending the rope with the rope management device, but merely using it to maintain a position on the rope 5. However, the operation of the rope management device remains the same regardless of the situation.

In order to rappel using the rope management device, descend the rope 5 using the rope management device, or otherwise move away from the anchor using the rope management device, the user pulls against the brake release lever 10*c* when the rope management device is in the clamped position. By pulling downward on the brake release lever 10*c*, the user directly counteracts the clamping force by increasing the distance between upper brake 10 and lower brake 20.

Pulling on the brake release lever 10*c* also causes the channel between the upper brake 10 and the lower brake 20 to put a less severe S-shaped bend in the rope 5, reducing the frictional force applied to the rope. The harder that the brake release handle 10*c* is pulled, the less friction the rope management device provides to the rope 5. This gives the user control over the speed that the rope is allowed to feed back through the rope management device (and in turn the speed of the descent).

During operation of the rope management device, the fixed sideplates 50 and the access sideplates 60 effectively contain the rope 5 within the channel formed between the upper brake 10 and the lower brake 20. The sideplates 50, 60 themselves do not provide any clamping force on the rope 5 because the distance between the fixed sideplates 50 and the access sideplates 60 is preferably greater than the diameter of the rope 5. Additionally, the steps 30*c*, 30*d*, 40*c*, 40*d* on the bushings 30 and 40 prevent the fixed sideplates 50 and the access sideplates 60 from binding the upper brake 10 and the lower brake 20. Thus, the fixed sideplates 50 and the access sideplates 60 do not pinch the upper brake 10 or the lower brake 20 to otherwise impede rotation about the pivot points A, B, C, D.

As was explained above, in this embodiment the shape of the fixed and access sideplates 50, 60 preferably determine the distance between the upper brake 10 and the lower brake 20. Preferably, at the open position of the rope management device the distance between the upper brake 10 and the lower brake 20 is slightly greater than the diameter of the rope 5. Thus, a clamping force and an increased frictional force will be applied to the rope 5 as soon as the rope management device begins to transition towards the clamped position from the open position.

As was illustrated in FIG. 4B, the fixed sideplates 50 preferably include the stops 50*c* that dictate the maximum value of the angles DAB and BCD. However, in other embodiments of the invention the stops could just as easily be located on the access plates 60, on both the access plates 60 and the fixed plates 50, on the lower brake 20, on the upper brake 10, or on both the upper brake 10 and the lower brake 20.

The components of the rope management device may be made of a variety of materials, including, for example, aluminum, titanium, and steel. Some components may be made out of a material that is different from other components. In other words, the materials used for the components may be chosen to optimize strength, durability, weight, and ease of manufacture. Performance characteristics of the device may also be optimized by varying the materials used in certain components.

One of the advantages that embodiments of the invention, such as the embodiment described above, have over conventional devices is that the bushings 30, 40 simultaneously function as bearings, attachment points for conventional connectors, and as spacers that prevent the fixed and access sideplates 50, 60 from binding against surfaces of the upper brake 10 and lower brake 20. This allows for an extremely compact device.

Another advantage that embodiments of the invention, such as the embodiment described above, have over conventional devices is that the access sideplates 60 are held securely on the bushings 30, 40 by the conventional connector (carabiner, cable, rope, webbing, etc) that passes through the bushings.

One of ordinary skill in the art will recognize that the concepts taught herein can be tailored to a particular application in many other advantageous ways. In particular, those skilled in the art will recognize that the illustrated embodiment is but one of many alternative implementations that will become apparent upon reading this disclosure. For instance, while the exemplary embodiments described above were directed at situations where a user was ascending or descending a rope, the inventive concepts could be applied equally as well to other situations where a rope management device is needed.

The preceding embodiments are exemplary. Although the specification may refer to "an", "alternative", or "some" embodiment(s) in several locations, this does not necessarily mean that each such reference is to the same embodiment(s), or that the feature only applies to a single embodiment.

Many of the specific features shown herein are design choices. The particular shape and size of the upper brake, lower brake, bushings, fixed plates, access plates, and brake release handle are all merely presented as examples, as are the number and location of the springs. For instance, it is anticipated that the shape of the fixed and access plates and the location of the stops on the fixed plates could be modified to allow for a different range of motion. Likewise, stops could be placed on the access plates, the fixed plates, the upper brake, the lower brake, or any combination of those components.

Similarly, in the embodiment illustrated above, the surfaces of the upper brake and lower brake that provide the clamping and frictional forces on the rope are flat, but such need not be the case. For example, because ropes have a circular cross section, in order to optimize weight other embodiments of the invention might have upper brakes and lower brakes with edges that are arched or rounded. Thus, weight is saved by removing material from the upper brake and lower brake that would not normally come into contact with the rope anyway. Such minor modifications are encompassed within the embodiments of the invention, and are intended to fall within the scope of the appended claims.

Functionality shown embodied in a single component may be implemented using multiple cooperating components, or vice versa. For example, in the exemplary embodiment illustrated above the brake release handle 10*c* is an integral part of the upper brake 10. Other embodiments of the invention may have brake release handles that are detachably affixed to the upper brake. Likewise, in alternative embodiments of the invention a bushing and a fixed sideplate could be machined, forged, die-cast, or otherwise manufactured as one single component. Such minor modifications are encompassed within the embodiments of the invention, and are intended to fall within the scope of the appended claims.

We claim:

1. A rope management device comprising:

an upper brake having a first pivot hole, a second pivot hole, and a handle, wherein the first pivot hole is configured to be linked to an end of a rope;

a lower brake having a third pivot hole and a fourth pivot hole;

a first sideplate rotatably affixed to a first side of the upper brake at the first pivot hole and rotatably affixed to a first side of the lower brake at the fourth pivot hole;

a second sideplate rotatably affixed to a second side of the upper brake at the first pivot hole and rotatably affixed to a second side of the lower brake at the fourth pivot hole;

a third sideplate rotatably affixed to the first side of the upper brake at the second pivot hole and rotatably affixed to the first side of the lower brake at the third pivot hole; and a fourth sideplate rotatably affixed to the second side of the upper brake at the second pivot hole and rotatably affixed to the second side of the lower brake at the third pivot hole.

2. The device of claim 1, the first and third sideplate configured to limit a minimum value of an angle with a vertex at the first pivot hole, a first endpoint at the second pivot hole, and a second endpoint at the fourth pivot hole.

3. The device of claim 2, the first sideplate comprising a stop that is configured to limit a maximum value of the angle when the stop contacts the third sideplate.

4. The device of claim 1, the first sideplate and the second sideplate further comprising a first hole that is substantially aligned with the first pivot hole, wherein the first hole and the first pivot hole have a diameter large enough to accept a connector.

5. The device of claim 4, the connector comprising one chosen from the group consisting of a portion of the rope, a cable, a lanyard, and a carabiner.

6. The device of claim 4, the first sideplate and the second sideplate further comprising a second hole that is substantially aligned with the fourth pivot hole, wherein the second hole and the fourth pivot hole have a diameter large enough to accept one chosen from the group consisting of a bolt, pin, or rivet.

7. The device of claim 1, the second sideplate configured to be detached from the upper brake at the first pivot hole and the fourth sideplate configured to be detached from the lower brake at the third pivot hole such that the second and fourth sideplates may be rotated to unblock a channel between the upper brake and the lower brake.

8. The rope management device of claim 1, wherein the rope management device is configured to control a load that is linked to the device at the third pivot hole by operating on a portion of the rope that is aligned between the upper brake and the lower brake.

9. The rope management device of claim 1, wherein the rope management device is configured to remain unanchored to a supporting surface while in operation.

10. The rope management device of claim 1, wherein the first pivot hole has a larger diameter than the second pivot hole and the third pivot hole has a larger diameter than the fourth pivot hole.

11. The rope management device of claim 1, wherein the rope management device is configured to perform a self-advancing function.

12. A rope management device comprising:

a first braking surface;

a second braking surface; and a quadrilateral linkage that includes a first vertex, a second vertex, and four sideplates, the sideplates and the braking surfaces collectively forming a channel that is configured to hold a rope between the first and second braking surfaces, the quadrilateral linkage configured to adjust a distance between the first braking surface and the second braking surface, configured to adjust the amount of bend in the rope, and two of the four sideplates configured to be rotated to allow the rope to be removed from and inserted into the channel.

13. The device of claim 12, the quadrilateral linkage further comprising a parallelogram linkage.

14. The device of claim 8, further comprising:

an upper brake with a handle, the upper brake including the first braking surface; and a lower brake, the lower brake including the second braking surface.

15. The device of claim 8, each of the four sideplates comprising:

a hole, two of the four holes aligned with a first vertex of the quadrilateral linkage and the other two holes aligned with a second vertex of the quadrilateral linkage, the first vertex and the second vertex opposite each other.

16. The device of claim 15, the first braking surface and the second braking surface configured to decrease a width of the channel and rotate the channel in a first direction when the first and second vertices are moved apart by a first force.

17. The device of claim 16, the first braking surface and the second braking surface configured to increase the width of the channel and rotate the channel in a second direction when the first and second vertices are moved together by a second force.

18. The device of claim 16, the first braking surface and the second braking surface configured to increase the width of the channel and rotate the channel in a second direction when a second force is applied at the handle a handle that tends to push the first vertex and the second vertex together.

19. A rope management device comprising:

a first and a second brake;

a first and a second hole penetrating through the first and second brakes, respectively;

a first and a second bolt hole penetrating through the first and second brakes, respectively;

a first and a second bolt located inside the first and the second bolt holes, respectively;

a first and a second bushing located inside the first and second holes, respectively, each end of the first and second bushings having a collar, a distance between the collars on the first bushing and a distance between the collars on the second bushing greater than a thickness of the first brake and a thickness of the second brake, respectively; and four sideplates configured to connect the first and second brakes and to position a rope between the first and second brakes, each sideplate configured to fit on one of the collars.

20. The device of claim 19, the first and second brakes configured to contact more of the rope when a distance between the first hole and the second hole increases.

21. The device of claim 19, the first and second brakes configured to contact less of the rope when a distance between the first and the second holes decreases.

22. The device of claim 20, the first and second brakes configured to place the rope in an increasingly severe S-shaped bend as the distance between the first hole and the second hole increases.

23. The device of claim 21, the first brake comprising;

a handle configured to decrease the distance between the first and the second holes.

24. The device of claim 19, the first brake, the second brake, and the four sideplates configured to align the rope that passes through the device in a single plane regardless of the direction that the rope is passing through the device.

25. A rope management device comprising:

an upper brake having an upper bushing affixed to a first sideplate and a second sideplate; and a lower brake having a lower bushing affixed to a third sideplate and a fourth sideplate;

the upper bushing and the lower bushing configured to function as bearings, as attachment points for a conventional connector, and as spacers that prevent the first and second sideplates from binding the upper brake and that prevent the third and fourth sideplates from binding the lower brake.

* * * * *